United States Patent [19]

Reimler et al.

[11] 4,280,541

[45] Jul. 28, 1981

[54] DEBARKING TOOL FOR LOG DEBARKING MACHINES

[75] Inventors: Marion W. Reimler, Charlotte; James L. Reimler, Matthews, both of N.C.; John S. Reimler, St. Simons Island, Ga.

[73] Assignee: Reimler Associates, Inc., Indian Trail, N.C.

[21] Appl. No.: 110,914

[22] Filed: Jan. 10, 1980

[51] Int. Cl.[3] ..... B27L 1/00

[52] U.S. Cl. ..... 144/208 E; 144/241

[58] Field of Search ..... 76/101 R, 101 A; 144/208 R, 208 E, 241

[56] References Cited

U.S. PATENT DOCUMENTS

| | | | |
|---|---|---|---|
| 2,880,771 | 4/1959 | Annis, Jr. | 144/208 E |
| 2,911,020 | 11/1959 | Wennberg | 144/208 E |
| 3,282,310 | 11/1966 | Morenius et al. | 144/208 E |
| 3,333,615 | 8/1967 | Robbins | 144/208 E |
| 3,361,168 | 1/1968 | Brown | 144/208 E |

*Primary Examiner*—W. D. Bray

*Attorney, Agent, or Firm*—Bell, Seltzer, Park & Gibson

[57] ABSTRACT

A debarking tool for a rotor type debarking machine is provided with an arcuate body having a substantially sharp log engaging climbing edge portion so arranged thereon and positioned closely adjacent a cutter member on the adjacent free end of the arcuate body as to aid the logs in quickly deflecting the debarking tool out of the path of the logs during rotation of the tool with the ring rotor.

10 Claims, 11 Drawing Figures

DEBARKING TOOL FOR LOG DEBARKING MACHINES

FIELD OF THE INVENTION

This invention relates to debarking machines of the type having a ring rotor into and through which successive logs are fed to be engaged and stripped of bark thereon by cutting edges of cutter members on the free ends of arcuate debarking tools rotatably supported by the ring rotor. More particularly, the invention is concerned with an improved debarking tool for debarking machines of the type described.

BACKGROUND OF THE INVENTION

As is generally known to those familiar with debarking machines of the ring rotor type, several debarking tools are circularly arranged around the central opening of the rotor and extend generally radially inwardly with their cutting edges positioned adjacent the axis of the rotor. When the rotor is rotated and a log is being fed into the rotor inlet, the leading butt end of the log engages the debarking tools and causes them to rotate outwardly in opposition to conventional resilient means so that the cutting edges of the tools climb upwardly onto the peripheral surfaces of the log for debarking same.

In recent years it has become an increasingly prevalent practice to use powered cutting jaws instead of powered cutting saws in the harvesting of trees. While this technique has facilitated the felling and harvesting of trees, the trees no longer have relatively square cut butt ends but instead have irregular somewhat conically shaped pinched ends. This has resulted in new problems attendant to the debarking of trees. As is well known, conventional debarking machines have their circularly arranged debarking tools each provided with a climbing edge for the purpose of engaging the leading butt end of the log and for quickly moving the debarking tool outwardly to the periphery of the log for performing debarking thereof. Debarking tools with climbing edges thereon are disclosed in U.S. Pat. Nos. 2,880,771 (Annis, Jr.); 3,709,272 (Bowers); and 3,973,607 (Jonsson), for example.

With this new technique of harvesting trees with powered cutting jaws, no longer are the logs provided with a relatively square butt end for ready engagement of the climbing edge of the debarking tool therewith. This has resulted in the relatively short rearwardly projecting climbing edge of the prior art debarking tools not always being engaged by the logs. Thus the debarking tools were not always moved sufficiently out of the longitudinal path of travel of the log through the debarking machine, with the result that breakage of the tools has occurred due to the impact of the logs with the debarking tools.

Further, prior art debarking tools typically have cutter members on the free ends thereof that are likely to be engaged by the leading end of each successive log being fed and since such cutter members or portions thereof are preferably made from a hard metal, such as sintered carbide, and which is therefore quite brittle, such cutter members may be fractured upon impact thereof by the leading butt end of a log, thus requiring replacement of the cutter members.

SUMMARY OF THE INVENTION

It is therefore an object of this invention to provide an improved debarking tool which is provided with a climbing edge thereon so shaped and arranged as to readily work with trees irrespective of the manner in which they were harvested; that is, by powered saws or by powered cutting jaws, and to also protectively shield the cutter member from impact by the leading ends of successive logs being fed into the debarking machine.

It is another object of this invention to provide a debarking tool of the character described having an elongate arcuate body provided with an arcuate concave inner climbing surface extending between opposing ends thereof and adapted to be engaged by successive logs during debarking thereof, and wherein the arcuate concave climbing surface is so constructed as to provide a quicker response for moving the debarking tools out of the path of the logs and also to be more wear resistant and to provide a longer useful life thereto.

BRIEF DESCRIPTION OF THE DRAWINGS

Some of the objects and advantages having been stated, others will appear as the description proceeds when taken in connection with the accompanying drawings, in which.

DETAILED DESCRIPTION

Referring more specifically to the drawings, the improved debarking tool there shown is broadly designated at 10 and comprises an elongate arcuate body 11 of generally rectangular cross-section having a base or flange 12 on its outer end serving as mounting means defining one of the opposed ends of the arcuate body 11 and adapted for rotatably supporting the debarking tool 10 on a ring rotor R of a conventional debarking machine. It is apparent that several of the debarking tools 10 may be supported by rotor R in circularly spaced relation to each other. The debarking machine may be of a well known type such as is disclosed in Annis, Jr., U.S. Pat. No. 2,880,771 and thus further details of the debarking machine need not be shown herein. However, to the extent necessary for a clear understanding of the present invention, the disclosure of the Annis, Jr. patent is incorporated herein by references.

Figure 1:
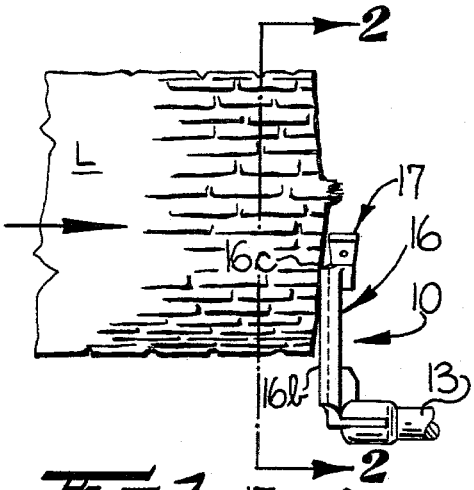
FIG. 1 is a fragmentary side elevation of a portion of the leading end of a log in engagement with the rear climbing edge of one of the improved debarking tools of the present invention, wherein the debarking tool occupies its normally inwardly biased position as occupied in a conventional rotor type debarking machine.
Figure 2:
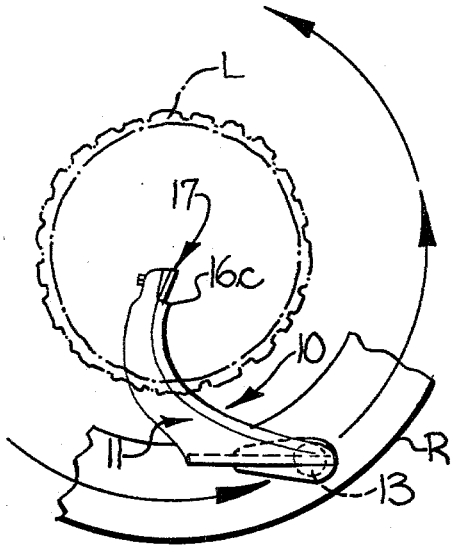
FIG. 2 is a view taken substantially along line 2—2 in FIG. 1, but showing the log in phantom lines, with the debarking tool being mounted on a portion of a conventional ring rotor.

As shown in FIGS. 1 and 2, the mounting means for the debarking tool 10 may also comprise a shaft 13 journaled in the ring rotor for rotation about an axis spaced generally radially outwardly of and extending substantially parallel to the central or rotational axis of the ring rotor 12. The outer end of shaft 13 may be bifurcated for receiving base 12 therein, with the base 12 being suitably secured to the bifurcated end of shaft 13 by suitable bolts, not shown.

The body 11 is provided with an arcuate concave inner surface, broadly designated at 16, which extends between opposing ends of body 11 and is adapted to face inwardly toward the rotational axis of the ring rotor R. The concave inner surface 16 is preferably of built-up wear-resistant construction, as will be later described.

A cutting means 17 is mounted on the other of the opposing ends of the arcuate body 11, which other end is free, and the cutting means 17 has a cutting edge thereon adapted for engaging a log for debarking the same. As shown, the cutting means 17 comprises a block member **17*a* (FIGS. 3, 5, 6 and 7) suitably secured on the free end of the arcuate body 11, as by a screw 17*b*. The cutting edge is defined on the cutting means 17 by a cutter member or bit 17*c* which is preferably in the form of a sintered carbide tip of substantially rectangular form and defines the aforementioned cutting edge. The cutter member 17*c* may be suitably secured on the outer end of the block member 17*a*** by any suitable means, such as by brazing.

As heretofore indicated, the arcuate body 11 of the debarking tool 10 is provided with the arcuate concave inner surface 16 extending between the distal opposing ends of the body 11. Now, as best shown in FIGS. 3, 4, 8 and 11, a portion of the concave inner surface 16 is defined by an elongate climbing edge portion **16*a* extending between the opposing ends of the arcuate body 11 for at least a substantial portion of the distance therebetween. Such climbing edge portion 16*a* projects rearwardly from the arcuate body 11 and has a substantially sharp edge 16*b* thereon defining a log engaging climbing edge for engagement by the leading ends of successive logs, such as the log L of FIG. 1, being fed into and through the ring rotor R for quickly deflecting the debarking tool 10 substantially out of the path of the logs during rotation of the tool with the ring rotor and thereby serving to protectively shield the debarking tool 10** from impact blows by the leading ends of the successive logs.

Figure 3:
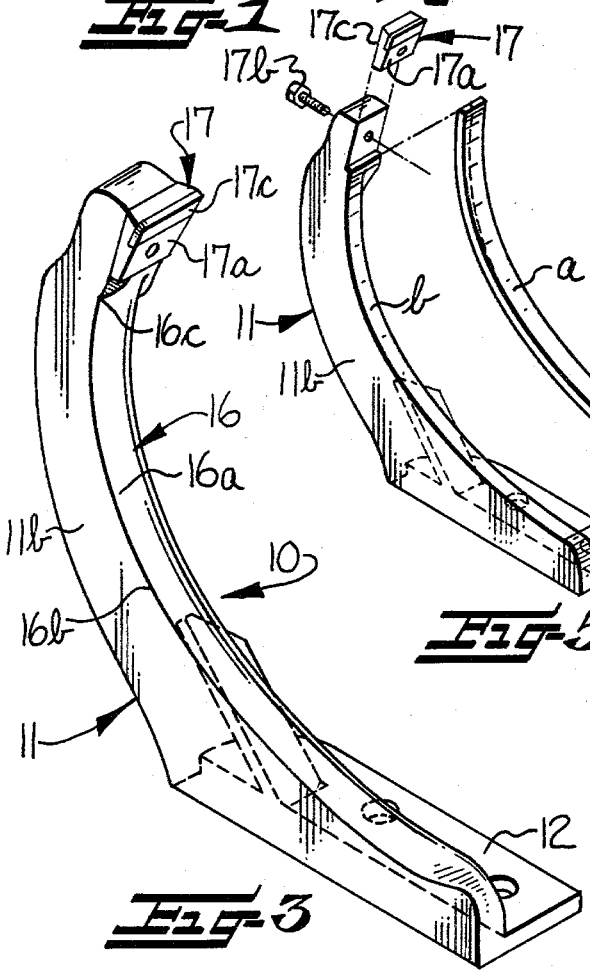
FIG. 3 is an enlarged perspective view of the improved debarking tool.
Figure 5:
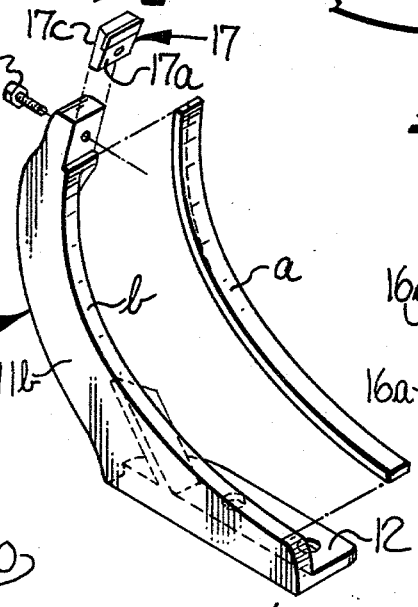
FIG. 5 is a view similar to FIG. 3, on a reduced scale, and showing certain components of the debarking tool in exploded relationship with respect to the body thereof.
Figure 4:
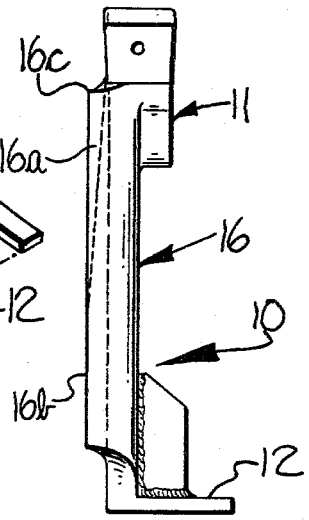
FIG. 4 is an enlarged view of the debarking tool as viewed in FIG. 1 and looking at the right-hand side of FIG. 2, but with the tool being removed from its supporting shaft.
Figure 6:
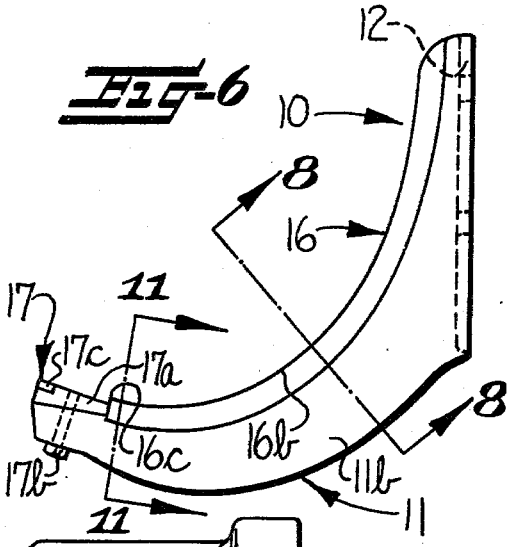
FIG. 6 is an enlarged rear elevation of the improved debarking tool similar to FIG. 2, but showing the debarking tool in a different position.
Figure 7:
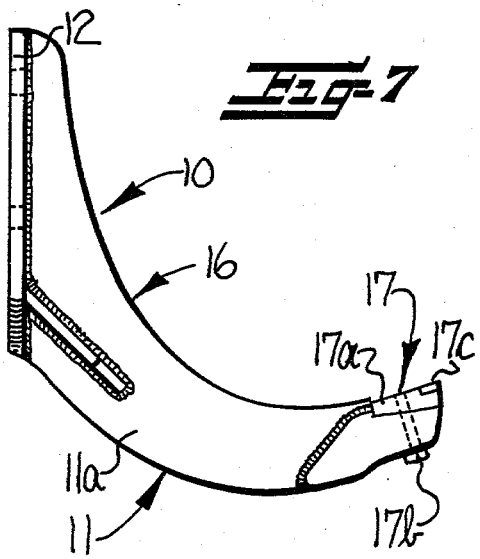
FIG. 7 is a view looking at the front side of the debarking tool opposite from the rear side thereof shown in FIG. 6.
Figure 8:
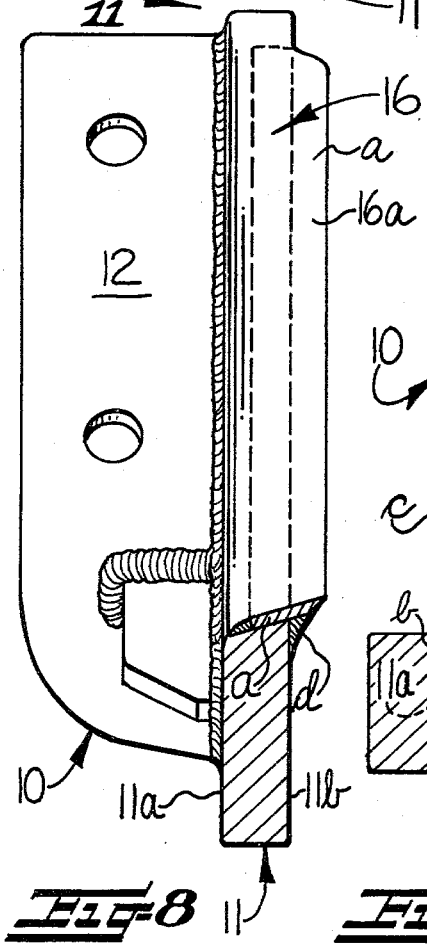
FIG. 8 is an enlarged fragmentary view, partially in section, taken substantially along line 8—8 in FIG. 6 and showing the built-up composite construction of the arcuate concave inner surface of the improved debarking tool.

As best shown in FIGS. 3 and 4, it will be observed that the climbing edge portion **16*a* has one end thereof terminating closely adjacent the cutter member 17*c* and defining a terminal corner portion 16*c* which projects rearwardly of the cutting means 17 for protectively shielding the cutter member 17*c* from impact by the leading ends of successive logs being fed into the rotor due to the rearwardly projecting terminal corner portion 16*c* being engaged by the leading ends of the successive logs, as shown in FIG. 1, and preventing the leading ends of the logs from engaging the cutter member 17*c*. It has been determined that the rearwardly projecting terminal corner portion 16*c* of the log engaging climbing edge 16*b*** has been found to be particularly useful in initiating deflection of the debarking tool out of the paths of travel of the leading ends of logs wherein the leading ends have the irregular pinched configuration earlier described.

It is preferred, therefore, that the relatively sharp log engaging climbing edge **16*b* project rearwardly from the arcuate body 11 at least about ½ inch (12.7 mm), with a desired range being from ½ inch to about 1 inch (12.7 mm to about 25.4 mm) and with a projection of about ⅞ inch (about 22.25 mm) having been determined to present a most favorable operating climbing edge. Also, as already noted, such climbing edge should have the terminal corner portion 16*c* thereof offset from the cutting means 17 so as to project rearwardly therefrom in like amount as from the body 11**.

For a clearer understanding of the significance of the extent of projection of the climbing edge of this invention, it should be realized that, typically in the prior art, climbing edges have been provided that project rearwardly from the body of the debarking tool substantially less than ½ inch (12.7 mm) and normally having a projection of no more than ¼ inch (6.35 mm). It should be understood that while these relatively short projecting prior art climbing edges work very effectively with generally squared butt ended sawed logs, they have continued to present real problems in the handling and debarking of logs harvested by the relatively new technique of powered cutting jaws.

As shown, and as is preferred, the major portions of opposing front and rear side surfaces **11*a*, 11*b* of the body 11 are substantially flat and substantially parallel to each other, with the elongate climbing edge portion 16*a* projecting rearwardly from the rear side surface 11*b*. However, the opposing side surfaces 11*a*, 11*b* may be irregular, if desired, provided that the relatively sharp log engaging climbing edge 16*b* of the climbing edge portion 16*a*, and especially its terminal corner portion 16*c*, project rearwardly of the body 11 and of the cutting means 17 so that irregular leading ends of successive logs being fed into the ring rotor R will engage the climbing edge 16*b* without abutting the cutting means 17. As heretofore indicated, if the leading ends of successive logs are permitted to strike the cutting means 17, this might fracture the cutting means, particularly the carbide cutter member or bit 17*c* thereof. However, the terminal corner portion 16*c* may form a slight indentation in the leading end of a log immediately upon movement thereof against the climbing edge 16*b* and thereby cause the debarking tool 10 to be quickly deflected out of the path of the corresponding log during rotation of the debarking tool 10 with the ring rotor R and thereby serve to protectively shield the debarking tool 10, including the cutter member 17*c*** thereof, from impact blows by the leading end of the corresponding log or logs.

As each successive log L being fed engages the climbing edge 16b of each debarking tool 10, it is apparent that the tool 10 is swung outwardly about its pivotal axis as defined by the supporting shaft 13 (FIGS. 1 and 2) so that the periphery of the log rubs against at least a portion of the climbing edge portion 16a of the arcuate concave inner surface 16 of the body 11 of the debarking tool 10. Since the body 11 and base 12 may be fabricated from a relatively soft metal, it is preferred, in accordance with this invention, that the elongate climbing edge portion 16a and its relatively sharp edge 16b are formed of a relatively hard, longer-lasting wear-resistant material as compared to the material in the body 11 and the base 12, it being noted that a relatively soft metal is desirable for the body, since the harder the metal, generally the more brittle and thus the more frangible it is.

Figure 9:
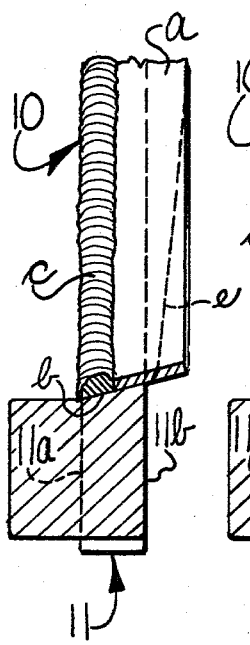
FIGS. 9, 10 and 11 are enlarged fragmentary cross-sectional views illustrating successive stages in construction of the built-up arcuate concave inner surface of the debarking tool, with FIG. 11 being taken substantially along line 11—11 in FIG. 6 and FIGS. 9 and 10 corresponding to FIG. 11 in the earlier stages of construction.
Figure 10:
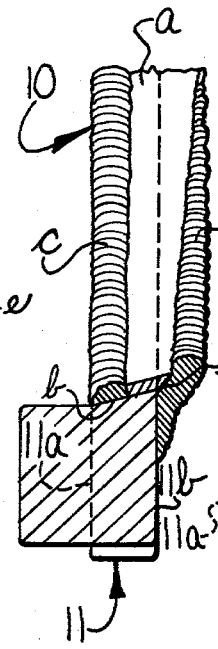
Figure 11:
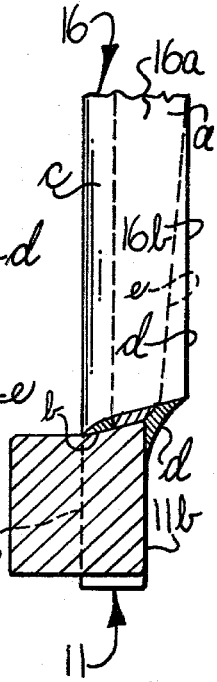

Accordingly, the arcuate concave inner surface 16 of the debarking tool body 11 preferably is of built-up or composite construction and is formed of an arcuate wear-resistant metal reinforcing strip a (FIG. 5), which strip is preferably a stainless steel substantially rectangular strip and is welded against and extends longitudinally of a corresponding concave inner arcuate edge b of body 11. The stainless steel strip a is welded to the body 11 by means of front and rear welds c, d (FIGS. 9–11) extending along respective longitudinal front and rear edges of the stainless steel strip a. FIGS. 9–11 illustrate a convenient sequence of successive stages in the process of forming the composite arcuate concave inner surface 16 on the body 11, and it will be observed in FIG. 9 that the arcuate strip a is positioned against the arcuate edge b of body 11 with the front or left-hand longitudinal edge of strip a being spaced rearwardly from the front side surface 11a of the body 11, and with a substantial portion of the strip a projecting rearwardly beyond the rear surface 11b of the body 11.

The left-hand or front longitudinal edge of strip a is then welded or fused to the corresponding edge b of the body 11 by the weld c which then may be in the form of a bead weld projecting outwardly from the concave face of the arcuate strip a. Preferably, the arcuate inner edge b of body 11 is beveled as shown in FIGS. 8–11 so that it slopes downwardly and forwardly at an acute angle with respect to the rear side surface 11b of body 11, as it appears in these figures, and so that the rear overhanging portion of the wear-resistant strip a extends upwardly and rearwardly at an obtuse angle relative to the rear side surface 11b of body 11.

By comparing FIGS. 9 and 10, it will be observed that a substantial rear portion of the wear-resistant reinforcing strip a is cut away in an undercut beveled manner so that the end of strip a adjacent the free end of body 11 is relatively narrow and a rear undercut edge e thereof diverges at a shallow angle relative to the body rear end surface 11b toward that end of the body 11 having the base 12 thereon. The rear undercut diverging edge e may extend for about one-half the length of the strip a, for example, with the strip a being of a generally uniform width along its remaining length.

The rear weld d is then formed as a fillet bead weld (FIG. 10) projecting rearwardly of and beyond the diverging rear undercut edge e of the arcuate wear-resistant strip a and outwardly therefrom. At this stage, the rear weld d also underlies the strip edge e and extends along the rear side surface 11b of the body 11 to provide a substantial mass to the rear weld d and to firmly secure the strip a to the body 11. After the welds c, d have been formed in substantially the manner illustrated in FIG. 10, the excess bead portions of the respective welds are preferably ground away so that the welds extend in substantially smooth and merging relationship with the arcuate inner surface of body 11 defined by the wear-resistant stainless steel strip a.

Thus, as illustrated in FIG. 11, the rear weld d projects rearwardly beyond the rear edge of the steel strip a so as to form the elongate climbing edge portion 16a having the relatively sharp log engaging climbing edge 16b thereon projecting rearwardly from the rear side surface 11b of the body 11. In order that the edge 16b may be substantially straight, the rear weld d also may be ground so that its lower surface slopes forwardly and downwardly from its relatively sharp edge 16b and into fused relation with the rear side surface 11b of the body 11 and below the steel strip a.

In practice, very favorable results have been obtained wherein the body 11 of the debarking tool 10 was made from a tough, low-carbon steel having a Brinnell standard hardness number of about 200 to 250. The stainless steel strip a was harder than the body 11, and the welds c, d were substantially harder than the body 11 and the stainless steel strip a. Although the front weld c need not be any harder than the body 11 and the strip a, it is desirable that the rear weld d be relatively hard so that the log engaging climbing edge 16b thereof and the rearwardly projecting terminal corner portion 16c may remain sharp during substantial periods of hard usage, and may withstand repeated resharpenings when needed. Favorable results were obtained by utilizing a welding rod of relatively high nickle-chrome content for forming the welds c, d drawn to a Rockwell hardness of at least about 45 to 55, C-scale. While it is desirable that the body 11 be relatively softer than the reinforcing strip a and that at least the rear weld d be harder than the reinforcing strip, it is apparent that persons familiar with the applicable arts may employ other metals in the manufacture of the log debarking tool 10 without departing from the present invention.

It is thus seen that the present invention provides a debarking tool having a substantially sharp log engaging climbing edge 16b which is capable of favorably withstanding hard usage and repeated forces attendant to the operation of a typical debarking machine, and wherein the log engaging climbing rear edge 16b terminates closely adjacent the cutter member 17c of cutting means 17 and there defines a terminal corner portion 16c which aids in causing the debarking tool 10 to be quickly swung out of the path of the leading end of each successive log L being fed into the ring rotor R irrespective of whether the corresponding tree may have been felled by the use of a powered saw or by the use of powered jaws, that is, irrespective of whether the log is provided with a relatively square cut leading butt end or an irregular somewhat conically shaped pinched end. Furthermore, it can be seen that the terminal corner portion 16c, by projecting rearwardly of the body 11 and the cutting means 17, protectively shields the cutting means from impact by the leading ends of successive logs L being fed into the ring rotor R.

In the drawings and specification there has been set forth a preferred embodiment of the invention, and although specific terms are employed, they are used in a generic and descriptive sense only and not for purposes of limitation.

That which is claimed is:

1. A debarking tool for a debarking machine of the type having a rotatable ring rotor through which logs are longitudinally fed forwardly during debarking thereof, said tool comprising an elongate arcuate body having opposing ends and an arcuate concave inner surface extending therebetween and adapted to face generally inwardly toward the rotational axis of the ring rotor, mounting means defining one end of said arcuate body and adapted for rotatably supporting the debarking tool on the ring rotor, the other end of said body being a free end, a cutter member mounted on said free end of said arcuate body and having a cutting edge adapted for engaging a log for debarking the same, an elongate climbing edge portion extending between said opposing ends of said arcuate body for at least a substantial portion of the distance therebetween and defining a portion of said arcuate concave inner surface, said climbing edge portion projecting rearwardly from said arcuate body and having a substantially sharp edge thereon defining a log engaging climbing edge for engagement by successive logs being fed forwardly for quickly deflecting the debarking tool substantially out of the path of the logs during rotation of the tool with the ring rotor and thereby serving to protectively shield the debarking tool from impact blows by the leading ends of the successive logs, and said climbing edge portion having one end terminating closely adjacent said cutter member and defining a terminal corner portion projecting rearwardly of said cutter member for protectively shielding said cutter member from wear and impact by the leading ends of successive logs being fed forwardly into the rotor due to the rearwardly projecting terminal corner portion being engaged by the leading ends of the logs and preventing the leading ends of the logs from engaging the cutter member.

2. A debarking tool according to claim 1 wherein said arcuate concave inner surface of said body is of built-up composite construction to provide a long lasting wear-resistant surface thereon and comprises an arcuate steel reinforcing strip so positioned on said body as to define at least a substantial portion of the length of said arcuate concave inner surface thereof, said strip having a longitudinal rear edge thereof welded to said body by a rear weld having a substantially sharp rear edge thereon with the rear weld extending along and projecting rearwardly beyond said longitudinal rear edge of said strip so as to define at least a portion of said substantially sharp rear climbing edge along said inner surface of said body, and said steel reinforcing strip and said rear weld both being harder than said body.

3. A debarking tool according to claim 2 wherein said reinforcing strip is stainless steel, and wherein said rear weld is harder than said steel strip and has a Rockwell C-scale hardness of at least about 45.

4. A debarking tool according to claim 3 wherein said rear weld has a Rockwell hardness in the range of about C45 to C55.

5. A debarking tool according to any one of claims 1, 2, 3 or 4 wherein said elongate log engaging climbing edge projects rearwardly in the range of ½ inch to about 1 inch (12.7 mm to about 25.4 mm) from said elongate arcuate body.

6. A debarking tool according to claim 1 wherein said arcuate concave inner surface of said body is of built-up composite construction to provide a long-lasting wear-resistant surface thereon and comprises an elongate arcuate stainless steel reinforcing strip harder than said body and positioned on said body so as to define at least a substantial portion of said concave inner surface thereof, said stainless steel strip being welded to said body by front and rear welds extending along respective front and rear longitudinal edges of said strip, said welds being substantially smooth and merging with said arcuate concave inner surface as defined by said strip, at least said rear weld being harder than said stainless steel strip, said rear weld projecting rearwardly beyond said rear longitudinal edge of said strip to define at least a portion of said elongate climbing edge portion projecting rearwardly from said body, said rear weld also terminating in a relatively sharp rear edge for defining a corresponding portion of said substantially sharp log engaging climbing edge along said arcuate concave surface of said body, and said rear weld having a lower surface sloping forwardly and downwardly from its relatively sharp rear edge and into fused relation with said body below said stainless steel strip.

7. A debarking tool for a debarking machine of the type having a rotatable ring rotor through which logs are longitudinally fed forwardly during debarking thereof, said tool comprising an elongate arcuate body having opposing ends and an arcuate concave inner surface extending therebetween and adapted to face generally inwardly toward the rotational axis of the ring rotor, mounting means on one end of said arcuate body and adapted for rotatably supporting the debarking tool on the ring rotor on an axis radially outwardly of and extending generally parallel to the rotational axis of the ring rotor, the other end of said body being a free end, cutting means including a block mounted on said free end of said arcuate body and having a cutting edge thereon adapted for engaging a log for debarking the same, an elongate climbing edge portion extending between said opposing ends of said arcuate body for at least a substantial portion of the distance therebetween and defining a portion of said arcuate concave inner surface, said climbing edge portion projecting rearwardly from said arcuate body and having a substantially sharp log engaging climbing edge thereon for engagement by successive logs being fed for quickly deflecting the debarking tool substantially out of the path of the logs during rotation of the tool with the ring rotor and thereby serving to protectively shield the debarking tool from impact blows by the leading ends of the successive logs, and said climbing edge portion having one end terminating closely adjacent said block of said cutting means and defining a terminal corner portion projecting rearwardly of said block for protectively shielding said cutting means from wear and impact by the leading ends of successive logs being fed forwardly and preventing the leading ends of the logs from engaging the cutting means.

8. A debarking tool for a debarking machine of the type having a rotatable ring rotor through which logs are longitudinally fed forwardly during debarking thereof, said tool comprising an elongate arcuate body of generally rectangular cross-section having a rear side surface and also having opposing ends and an arcuate concave inner surface extending between said opposing ends and adapted to face generally inwardly toward the rotational axis of the ring rotor, mounting means on one end of said arcuate body and adapted for rotatably supporting the debarking tool on the ring rotor on an axis radially outwardly of and extending generally parallel to the rotational axis of the ring rotor, the other end of said body being a free end, a cutter member mounted on said free end of said arcuate body and having a cutting edge thereon adapted for engaging a log for debarking the same, an elongate substantially sharp rear climbing edge extending between said opposing ends of said arcuate body for at least a substantial portion of the distance therebetween, said climbing edge also projecting rearwardly from said rear side surface of said body and along said arcuate concave inner surface of said body for defining a substantially sharp log engaging climbing edge thereon for engagement by successive logs being fed forwardly for quickly deflecting the debarking tool substantially out of the path of the logs during rotation of the tool with the ring rotor and thereby serving to protectively shield the debarking tool from impact blows by the leading ends of the successive logs, and said climbing edge having one end terminating closely adjacent said cutter member and defining a terminal corner portion projecting rearwardly of said cutter member for protectively shielding said cutter member from wear and impact by the leading ends of successive logs and preventing the leading ends of the logs from engaging the cutter member.

9. A debarking tool for a debarking machine of the type having a rotatable ring rotor through which logs are longitudinally fed forwardly during debarking thereof, said tool comprising an elongate arcuate body having opposing ends with mounting means defining one end of said body and adapted for rotatably supporting the debarking tool on the ring rotor, and the other end of said body being a free end, cutter means on said free end of said arcuate body and having a cutting edge adapted for engaging a log for debarking the same, said arcuate body having an arcuate concave inner surface of built-up composite construction to provide a long-lasting wear-resistant surface thereon extending between said opposing ends thereof and adapted to face generally inwardly toward the rotational axis of the ring rotor, said composite arcuate concave inner surface of said body comprising an elongate reinforcing strip positioned on said body and extending between said opposing ends thereof for at least a substantial portion of the distance therebetween and defining a portion of said concave inner surface, said reinforcing strip having a longitudinal rear edge thereof welded to said body by a weld which is harder than said strip and said body, and said weld extending along and projecting rearwardly from and beyond said longitudinal rear edge of said strip and also projecting rearwardly of said body and having a substantially sharp rear edge thereon defining an elongate log engaging climbing edge for engagement by successive logs being fed forwardly for quickly deflecting the debarking tool substantially out of the path of the logs during rotation of the tool with the ring rotor and thereby serving to protectively shield the debarking tool from wear and impact blows by the leading ends of the successive logs.

10. A debarking tool according to claim 9 wherein said elongate log engaging climbing edge projects rearwardly of said elongate arcuate body about $\frac{7}{8}$ inch (about 22.25 mm).

* * * * *

UNITED STATES PATENT AND TRADEMARK OFFICE

CERTIFICATE OF CORRECTION

PATENT NO. : 4,280,541

DATED : July 28, 1981

INVENTOR(S) : Marion W. Reimler, James L. Reimler and John S. Reimler

It is certified that error appears in the above-identified patent and that said Letters Patent are hereby corrected as shown below:

Column 8, CLAIM 7, Line 51, after "fed" insert --forwardly--.

Signed and Sealed this

*Twentieth* Day of *October 1981*

[SEAL]

*Attest:*

GERALD J. MOSSINGHOFF

*Attesting Officer*

*Commissioner of Patents and Trademarks*